US005271363A

United States Patent [19]

Derra

[11] Patent Number: 5,271,363

[45] Date of Patent: Dec. 21, 1993

[54] REINFORCED CYLINDER FOR AN INTERNAL COMBUSTION ENGINE

[75] Inventor: Kenneth W. Derra, New Berlin, Wis.

[73] Assignee: Briggs & Stratton Corp., Wauwatosa, Wis.

[21] Appl. No.: 985,006

[22] Filed: Dec. 2, 1992

[51] Int. Cl.[5] ..... F02F 3/00

[52] U.S. Cl. ..... 123/193.2

[58] Field of Search ..... 123/193.2, 193.3, 193.4; 29/888.06, 888.061

[56] References Cited

U.S. PATENT DOCUMENTS

| | | | |
|---|---|---|---|
| 1,422,729 | 7/1922 | Waterhouse . | |
| 2,038,030 | 4/1936 | Doman . | |
| 2,242,761 | 5/1941 | Seyerle . | |
| 2,491,630 | 12/1949 | Voorhies . | |
| 3,659,569 | 5/1972 | Mayer et al. . | |
| 4,127,058 | 11/1978 | Rohrle | 123/193.2 |
| 4,184,463 | 1/1980 | Koga et al. | 123/193.2 |
| 4,202,310 | 5/1980 | Zorrilla et al. | 123/193.2 |
| 4,221,196 | 9/1980 | Castarede | 123/193.2 |
| 4,640,240 | 2/1987 | Ziegler et al. . | |
| 4,757,790 | 7/1988 | Ushio et al. . | |
| 4,791,891 | 12/1988 | Kubis et al. | 123/193.2 |
| 4,796,572 | 1/1989 | Heydrich | 123/193.2 |
| 4,856,462 | 8/1989 | Ushio et al. . | |
| 4,922,863 | 5/1990 | Adams | 123/193.2 |
| 4,926,813 | 5/1990 | Bonde | 123/193.2 |
| 5,095,868 | 3/1992 | Brighigna | 123/193.2 |

*Primary Examiner*—Tony M. Argenbright
*Assistant Examiner*—M. Macy
*Attorney, Agent, or Firm*—Andrus, Sceales, Starke & Sawall

[57] ABSTRACT

The engine housing for a small internal combustion engine lessens exhaust emissions by reducing cylinder bore distortion during manufacture and during use. Cylinder bore distortion is reduced by providing reinforcing material in two opposed wall sections for a relatively small length of the total cylinder length. This uppermost cylinder wall portion also includes bolt bosses for receiving the cylinder head bolts. The cylinder is divided into successive cylinder wall portions along its length, with the thicknesses of the cylinder walls decreasing in each wall portion away from the cylinder head. Cylinder bore distortion is also lessened by using concentric air vanes instead of the asymmetrically-shaped vanes typical of prior art engine housings.

12 Claims, 5 Drawing Sheets

FIG. 1
PRIOR ART
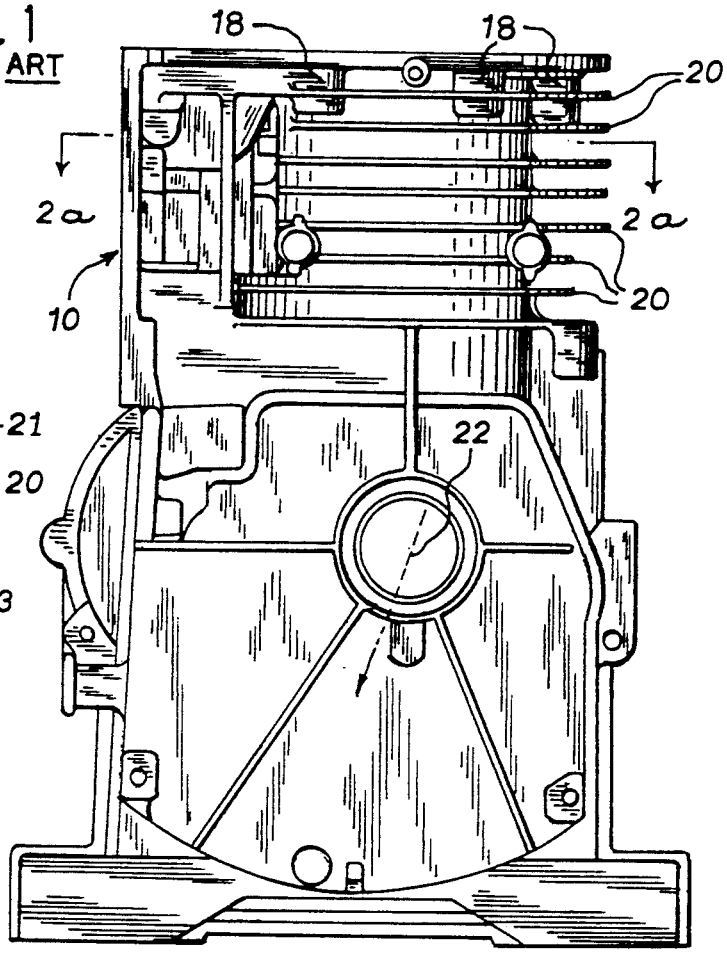
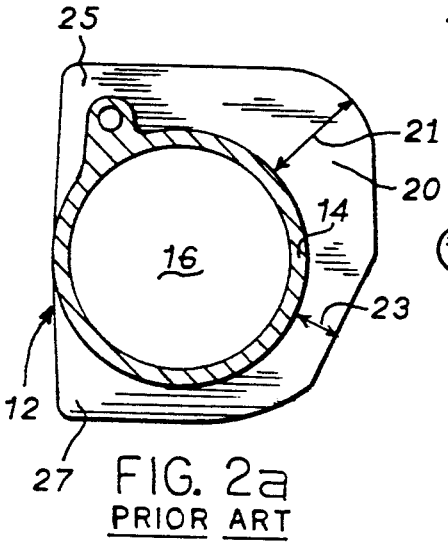
FIG. 2a
PRIOR ART
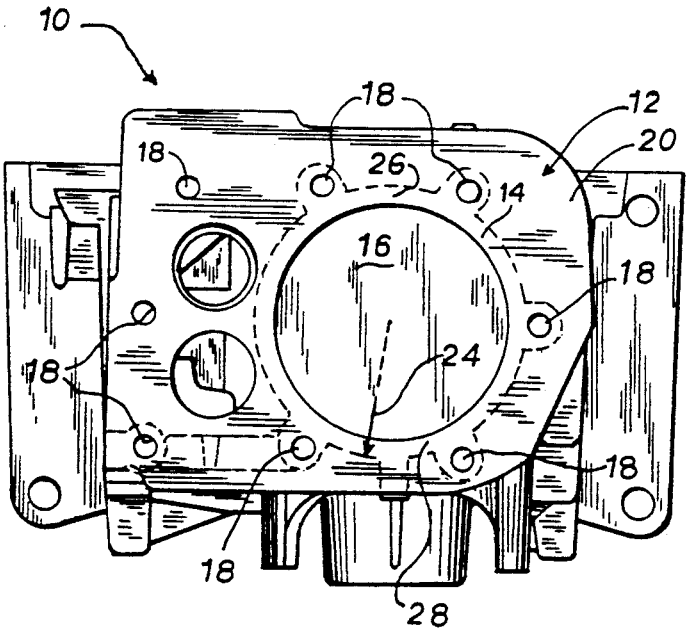
FIG 2
PRIOR ART FIG. 9
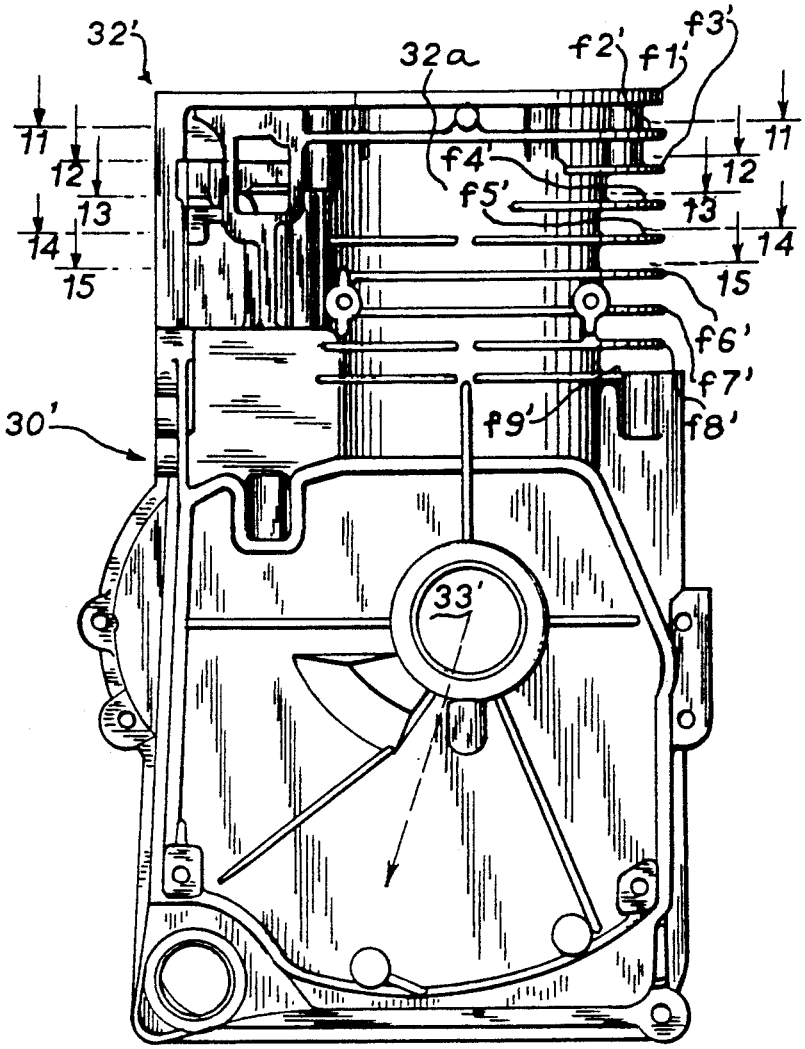
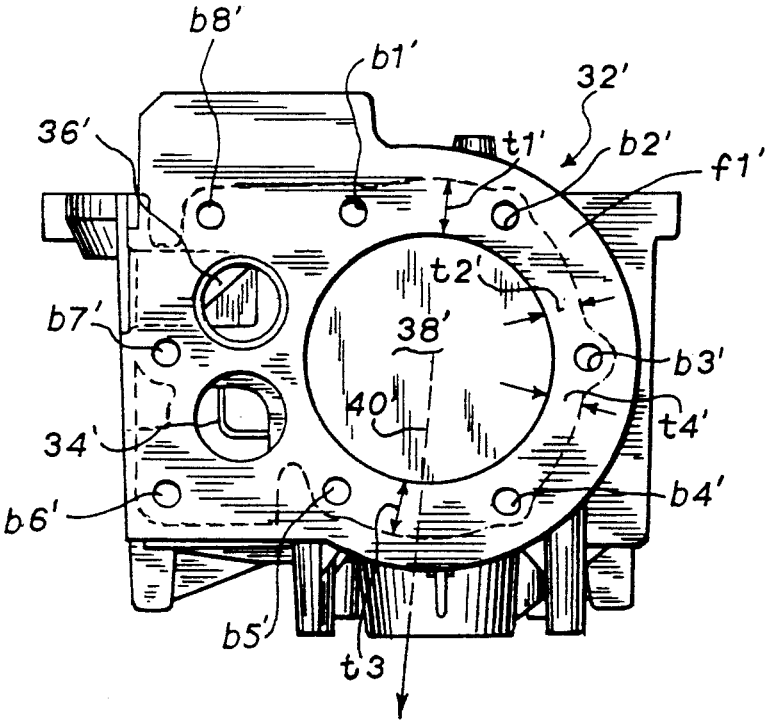
FIG. 10

REINFORCED CYLINDER FOR AN INTERNAL COMBUSTION ENGINE

BACKGROUND OF THE INVENTION

This invention relates to cylinders for internal combustion engines. More particularly, this invention relates to methods and apparatus for reducing the distortion of cylinders during their manufacture and use.

The problems and disadvantages of prior art cylinders are best understood by reference to FIGS. 1 through 2*a*. FIGS. 1, 2 and 2*a* depict a typical prior art housing for an air cooled single cylinder internal combustion engine. Referring to FIGS. 1, 2 and 2*a*, housing 10 includes a cylinder 12 defined by a cylinder wall 14. A cylinder bore 16 is disposed within cylinder 12 and is adapted to receive a reciprocating piston (not shown). The piston reciprocates along a longitudinal axis 24 of cylinder bore 16. A cylinder head (not shown) is bolted onto cylinder 12 by a plurality of bolts that are received in bolt bosses 18.

Projecting outwardly from cylinder 12 is a plurality of spaced fins or air vanes 20 which assist in heat dissipation from the air-cooled engine. Housing 10 also includes a crankshaft axis 22 about which a rotatable crankshaft rotates. The piston is connected to the crankshaft by a connecting rod (not shown).

As depicted in FIGS. 1 through 2*a*, the thickness of cylinder wall 14 is substantially uniform both in the direction parallel to longitudinal axis 24 of cylinder bore 16 (FIG. 1) and in the direction along the planes substantially normal to longitudinal axis 24 (FIGS. 2 and 2*a*).

Except in those instances when the thickness of wall 14 is very large, it has been found that the use of a typical uniform wall thickness results in the distortion of cylinder bore 16 from its ideal cylindrical shape. There are at least two primary causes for this bore distortion. First, the torquing of the cylinder head bolts into bolt bosses 18 during the manufacturing process introduces stresses to the engine housing material, resulting in distortion of the cylinder bore. The cylinder bore becomes elliptical, with the major axis of the ellipse being perpendicular to the piston's longitudinal axis and parallel to the crankshaft axis.

The second major cause of bore distortion is due to the thermal expansion of the bore during engine operation. This distortion induces expansion stresses into the engine housing material which, when coupled with the above-described stresses, causes yielding in the housing material and forces a permanent deformation (out of roundness) of the cylinder bore.

One major disadvantage of the cylinder bore distortion is that exhaust emissions are increased. Since the piston and rings have a substantially circular shape in cross section and the bore has a non-circular shape in cross section during engine operation due to bore distortion, it is apparent that small gaps will exist between the piston and ring outer wall surface and the bore inner surface. These gaps permit oil and gasses from the crankcase to leak into the combustion chamber and eventually out the exhaust valve into the environment. Exhaust emissions are thus undesirably increased due to the cylinder bore distortion.

One prior art way to substantially eliminate the cylinder bore distortion has been to uniformly and substantially increase the thickness of cylinder wall 14 along the entire length and the entire circumference of the cylinder. Although this method is effective, it greatly increases the amount of material that must be used in forming the engine housing. Particularly when the engine housings are mass produced in many thousands or even millions of units, the additional cost of providing such cylinder wall reinforcement is quite substantial.

Another cause of cylinder bore distortion is believed to be related to the shape of air vanes 20. As best shown in FIGS. 2 and 2*a*, air vanes 20 are typically asymmetrical in shape having varying radii of curvatures. In FIG. 2*a*, air vane 20 has a much greater length at section 21 than at section 23. Also, air vane 20 abruptly terminates at corners 25 and 27. As a practical matter, the air vanes are often designed to provide as much surface area for air cooling as space limitations will permit.

One disadvantage of using asymmetrical air vanes is that cylinder cooling will be different at different points along cylinder wall 14, depending upon the length and the shape of the fins nearest that point. For example, cylinder cooling will be different near section 21 than near section 23 (FIG. 2*a*) because air vane 20 has a much greater length at section 21 than at section 23. This unevenness in cylinder cooling is believed to be a cause of cylinder bore distortion.

Also, the degree of change in air vane length contributes to bore distortion. That is, the more abrupt the change, the greater the bore distortion. See corners 25 and 27 in FIG. 21, where the vane size changes abruptly.

SUMMARY OF THE INVENTION

A housing for an internal combustion engine is disclosed which minimizes cylinder bore distortion resulting from the manufacturing process and from thermal expansion during engine operation.

The engine housing has a unique cylinder design in which the uppermost cylinder wall portion has a wall thickness that is substantially uniform along the planes that are parallel to and coplanar with the longitudinal axis of the bore. However, the cylinder wall thickness decreases from a greater thickness at two opposed sections to a smaller thickness at a section displaced between the two opposed sections, in a plane perpendicular to the longitudinal bore axis. The two opposed sections having the extra wall thickness are positioned to coincide with the areas where stresses that lead to bore distortion would otherwise be the greatest. The two opposed sections extend for only a relatively small fraction of the total cylinder length.

The uppermost cylinder wall portion having the reinforced wall sections also has an overall thicker wall in a plane normal to the longitudinal bore axis when compared to other cylinder wall portions to accommodate the bolt bosses for the cylinder head mounting bolts. This extra wall thickness also minimizes cylinder bore distortion otherwise caused during the manufacturing process during the torquing of the mounting bolts.

The cylinder according to the present invention also has second, third and fourth cylinder wall portions disposed between the uppermost cylinder wall portion and the crankshaft axis of rotation. The second cylinder wall portion is disposed between the first and third cylinder wall portions and has a cylinder wall thickness that is uniform in both a plane substantially perpendicular to the bore's longitudinal axis, and in a plane substantially parallel to and coplanar with the bore's longitudinal axis. The wall thickness of the second cylinder wall portion is less than the maximum thickness of the first cylinder wall portion.

Similarly, the third cylinder wall portion is disposed between the second and fourth cylinder wall portions and has a thickness in both the vertical and horizontal planes that is substantially uniform. In a plane that is substantially normal to the bore's longitudinal axis, the wall thickness of the third cylinder wall portion is less than the wall thickness of the second cylinder wall portion.

The fourth cylinder wall portion is disposed between the third cylinder wall portion and the crankshaft axis. The fourth cylinder wall portion also has a wall thickness that is substantially uniform in the planes which are parallel and perpendicular to the bore's longitudinal axis. The wall thickness of the fourth cylinder wall portion in a plane perpendicular to the bore's longitudinal axis is less than the wall thickness of the third cylinder wall portion in a plane perpendicular to the bore's longitudinal axis.

By varying the cylinder wall thicknesses as described above, the applicant is able to minimize cylinder bore distortion using the least amount of material. The applicant provides the greatest amount of reinforcing material where it is most needed, in the uppermost cylinder wall portion, nearest to the place where engine combustion occurs. As the distance from the combustion chamber increases, the cylinder wall thickness decreases in successive cylinder wall portions to only use as much material as is necessary to maintain the ideal cylinder bore shape during engine operation.

The present invention also uses a plurality of spaced, substantially concentric air vanes to provide more even heat dissipation than in typical prior art engines. With even heat dissipation in all directions, cylinder bore distortion is lessened.

Whenever the vane length varies from the ideal concentric shape due to clearance limitations, the lengths of the air vanes of the present invention change very gradually to minimize bore distortion.

It is a feature and advantage of the present invention to reduce exhaust emissions from an air cooled internal combustion engine.

It is yet another feature and advantage of the present invention to minimize cylinder bore distortion without using excessive material in manufacturing the engine housing.

These and other features of the present invention will be apparent to those skilled in the art from the following detailed description of the preferred embodiments and the drawings, in which:

BRIEF DESCRIPTION OF THE DRAWINGS

FIG. 1 is a side view of a typical prior art engine housing for a single cylinder engine.

FIG. 2 is a top view of the prior art engine housing of FIG. 1.

FIG. 2*a* is a top cross sectional view of the typical prior art engine housing, taken along plane 2*a*—2*a* of FIG. 1.

FIG. 9 is a side view of a vertical shaft engine housing according to the present invention, the cylinder head having been removed.

FIG. 10 is a top view of the vertical shaft engine housing depicted in FIG. 9.

DETAILED DESCRIPTION OF THE PREFERRED EMBODIMENTS

The reinforced cylinder according to the present invention may be used with both horizontal shaft and vertical shaft engines, with some slight modifications, as discussed below, for part clearances. Modifications for other part clearances may also be required. FIGS. 3 through 8 depict a horizontal shaft engine incorporating the present invention. FIGS. 9 through 15 depict a vertical shaft engine incorporating the present invention.

The engine depicted and described below in connection with FIGS. 3 through 15 is a 3.5 hp, 9.02 cubic inch displacement engine having a cylinder bore diameter of 2.562 inches. The present invention is, of course, not limited to this particular engine, but may be used with any internal combustion engine. The dimensions described below should be scaled for different sized engines, which is well within the ability of the ordinary person skilled in the art. Specifically, the amount of reinforcing material to be added to the cylinder wall is a function of the bore diameter as well as the distance from the cylinder head gasket. The amount of selective reinforcing material to be added to the uppermost cylinder portions is a function of the position around the bore circumference.

Figure 3:
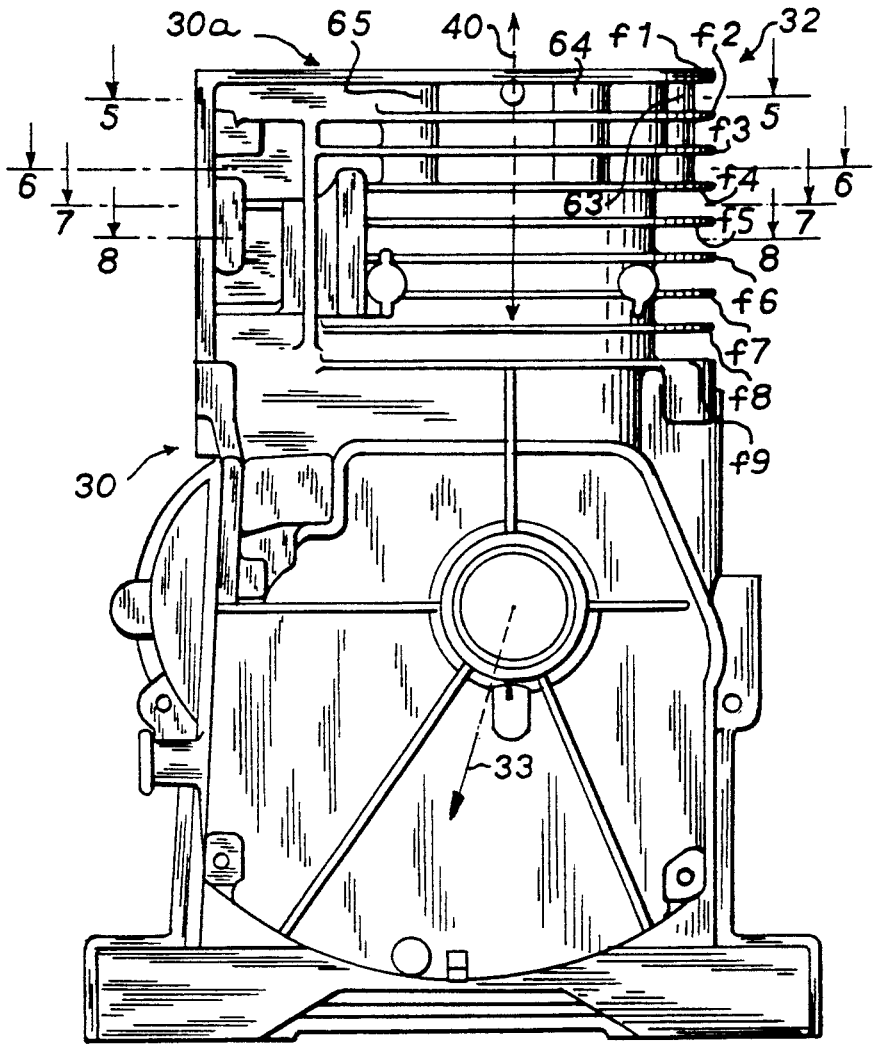
FIG. 3 is a side view of a horizontal shaft engine housing according to the present invention, the cylinder head having been removed.

FIG. 3 is a side view of a horizontal engine 30 incorporating the present invention. In FIG. 3, engine housing 30 has a cylinder 32 adapted to receive a reciprocating piston. The piston is connected to a crankshaft (not shown) via a connecting rod, with the crankshaft rotating about a crankshaft axis 33.

Projecting from cylinder 32 are a plurality of air vanes or fins which have been labeled f1 through f9 in FIG. 3. The engine cylinder has been divided into sections in the below discussion by reference to fins f1–f9. The reference to the fins is done to aid the explanation of the invention only; the cylinder sections may be divided in other places instead. Fins f1 through f9 are ideally substantially concentric and symmetrical to yield the most even heat dissipation throughout the cylinder. Some deviation from the ideal, circular shape of the fins is necessary near intake valve guide 34 and exhaust valve guide 36 of engine housing 30. This change in the fins is necessary due to space limitations.

Referring again to FIGS. 3 and 4, engine housing 30 is depicted with the cylinder head having been removed. The cylinder head (not shown) is bolted to upper end 30*a* of housing 30 via a plurality of mounting bolts (not shown). The mounting bolts are torqued into a plurality of mounting bosses b1 through b8. As best shown in FIG. 3, an uppermost portion of cylinder 32—defined as the cylinder portion between fins f1 and f3—has a greater wall thickness than the remainder of the cylinder, in part to incorporate the mounting bosses. This uppermost cylinder portion has a length of about 0.75–1 inches, for a bore of 3⅝ inches in length. Thus, this uppermost cylinder portion is preferably about 20 to 28 percent of the total bore length, although the uppermost cylinder portion could be between 15 to 35 percent of the total cylinder length. It has been found that the increasing of the wall thickness in the portion of the cylinder between fins f1 and f3 minimizes the distortion of cylinder bore 38 when the cylinder head is bolted to upper end 30*a* of engine housing 30. In the embodiment described herein, the overall wall thickness of the cylinder portion between fins f1 and f3 has been increased by about 100 to 200 percent when compared to prior art cylinders to minimize such bore distortion. The increasing of the overall wall thickness in the uppermost cylinder portion may decrease thermal bore distortion, even if this portion is not selectively reinforced as described below.

Figure 4:
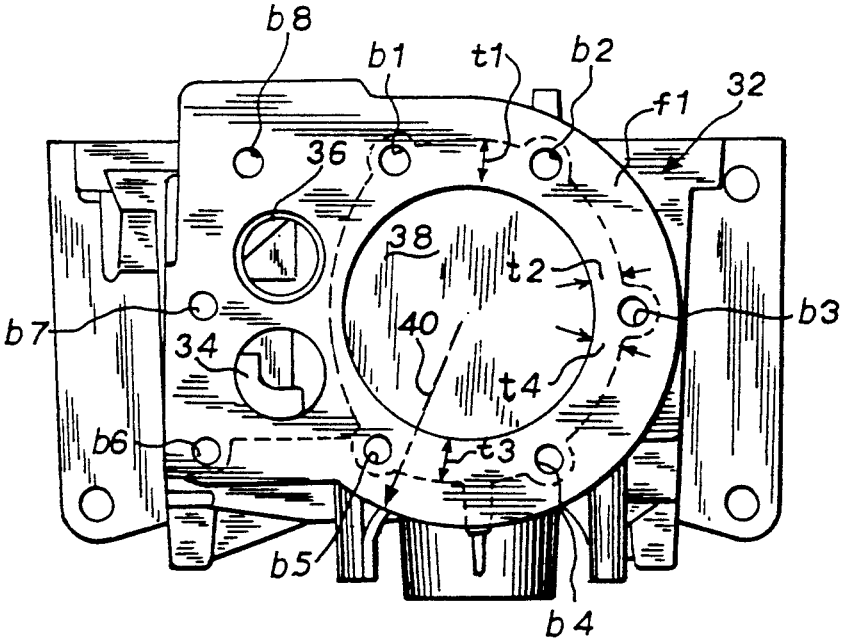
FIG. 4 is a top view of the horizontal shaft engine housing of FIG. 3.

A portion of the cylinder between fins f1 and f3 is also selectively reinforced to prevent thermal distortion of cylinder bore 38 during engine operation. Referring to FIG. 4, the inventor has discovered that bore 38 does not distort in equal amounts in all directions during engine operation. If the cylinder wall was not reinforced, the cylinder bore would distort the greatest between bolt bosses b1 and b2, and between bosses b4 and b5. With the reinforcement as depicted in FIG. 4, cylinder 32 tends to thermally expand the least in the two opposed cylinder wall sections between bolt bosses b1 and b2, and between bosses b4 and b5.

The above-described thermal expansion in an unreinforced cylinder results in a cylinder bore 38 having a somewhat elliptical shape during engine operation in a plane normal to longitudinal axis 40 instead of the ideal circular bore shape in that plane. The major axis of the ellipse is parallel to the crankshaft axis and is perpendicular to the bore's longitudinal axis 40. This elliptical shape is most prominent near the top of cylinder 32 between fins f1 and f3, and tapers down to a nearly ideal circular shape near fin f9.

Figure 5:
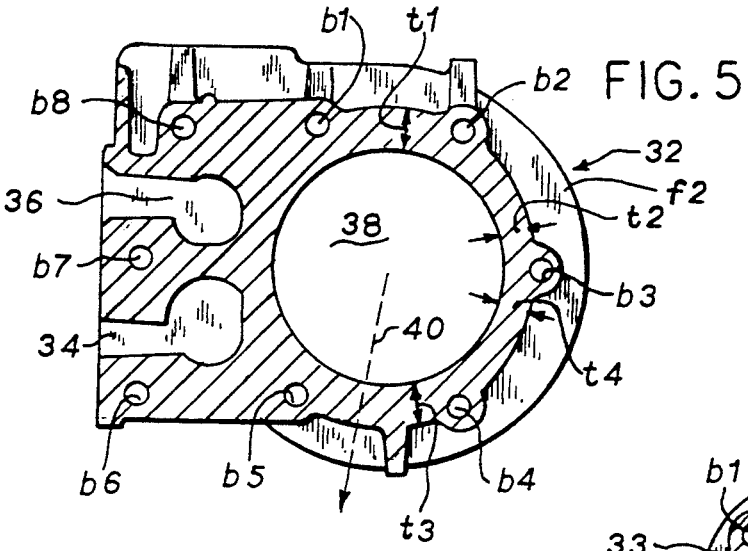
FIG. 5 is a top cross sectional view of the horizontal shaft engine, taken along plane 5—5 of FIG. 3.

Referring to FIGS. 4 and 5, the section of cylinder 32 in plane 5—5 (FIG. 5) between bosses b1 and b2 has a wall thickness t1 that is greater than thickness t2 in the cylinder section between bosses b2 and b3. Similarly, thickness t3 of the cylinder wall between bosses b4 and b5 is greater than thickness t2. Ideally, thickness t3 is substantially equal to or greater than thickness t1. Thicknesses t1 and t3 are generally on opposite sides of the cylinder in a plane 5—5 that is substantially normal to longitudinal axis 40 of cylinder bore 38. The section of the cylinder between bosses b3 and b4 should also have a reduced thickness t4 that is less than thickness t3 and substantially equal to thickness t2.

Since it has been found that thermal and mechanical stresses in cylinder 32 are greatest in the cylinder section between bosses b1 and b2, and in the cylinder section between bosses b4 and b5, the cylinder wall thicknesses are greatest in these sections. The thickness of the cylinder wall may gradually decrease in the cylinder wall sections between bosses b2 and b3 and between bosses b4 and b3 until they reach their minimum values, represented by thicknesses t2 and t4.

In the 3.5 horsepower, 9.02 cubic inch displacement engine discussed herein with a bore diameter of 2.562 inches, thicknesses t1 and t3 are on the order of 0.500 to 0.562 inches, with thicknesses t2 and t4 being on the order of about 0.188 to 0.250 inches. Thus, thicknesses t1 and t3 are preferably about 100 to 200 percent greater than thicknesses t2 and t4 respectively. However, thicknesses t1 and t3 may be only 50 to 100 percent greater than thicknesses t2 and t4 and still be effective in reducing bore distortion.

To manufacture an engine housing with the selectively reinforced portions discussed herein, the designer should start with an ellipse having longitudinal axis 40 at the center of the ellipse. If thickness $t1=0.5$ inches, a best fit circle of radius $r=1.660$ inches should be used for the cylinder wall section between bosses b1 and b2. For the cylinder wall sections between bosses b2 and b3, and between bosses b3 and b4, a best fit circle of 1.800 inches with an offset of 0.264 inches should be used to yield thicknesses $t2=t4=0.25$ inches.

The above dimensions assume that engine housing 30 is made from an aluminum-silicon-copper alloy with no fiber composite reinforcement in the alloy. The actual amount of additional cylinder wall reinforcing material may be varied depending upon the strength of the alloy used to make engine housing 30.

To further minimize distortion of bore 38, additional material has been added in the cylinder section between bolt bosses b5 and b6 in the section generally adjacent to intake valve guide 34 and exhaust valve guide 36. The amount of reinforcing material added in this section is on the order of 0.375 inches, or about 50 to 100 percent greater than in typical prior art engine housings.

Figure 6:
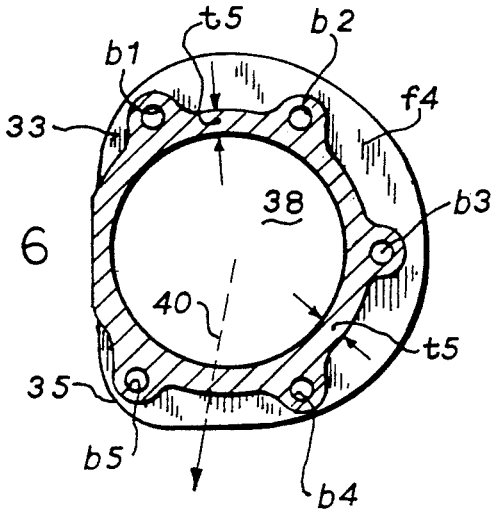
FIG. 6 is a top cross sectional view of the horizontal shaft engine housing, taken along plane 6—6 of FIG. 3.

FIG. 6 is a cross sectional top view of engine housing 30 of FIG. 3, taken along plane 6—6 of FIG. 3. FIG. 6 depicts a section of cylinder 32 between fins f3 and f4, with fin f4 being depicted in FIG. 6. This portion of cylinder 32 has a substantially constant wall thickness of about 0.220 inches in plane 6—6, compared to a wall thickness of about 0.125 inches in standard prior art cylinders. The portion of the cylinder between fins 3 and 4 may be manufactured using a best fit circle of radius $r=1.500$ inches from longitudinal axis 40. Thickness t5 of the cylinder wall portion depicted in FIG. 6 is between about 30 to 60 percent less than thickness t1, with 50 to 60 percent less being the preferred range.

Figure 7:
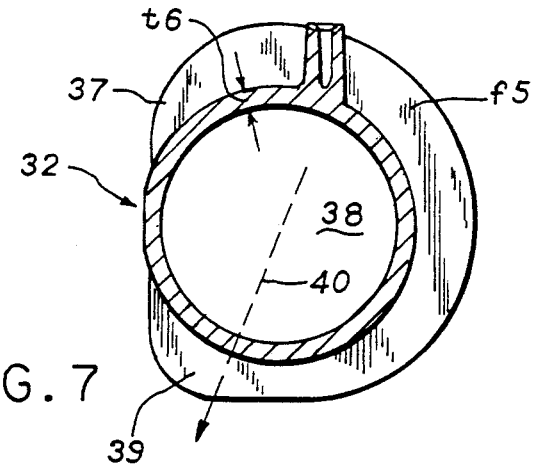
FIG. 7 is a top cross sectional view of the horizontal shaft engine housing, taken along plane 7—7 of FIG. 3.

FIG. 7 is a cross sectional top view of cylinder 32, taken along plane 7—7 of FIG. 3. FIG. 7 depicts a portion of the cylinder between fins f4 and f5, with fin f5 being shown in FIG. 7. The cylinder wall section depicted in FIG. 7 has a substantially constant cylinder wall thickness t6 of about 0.150 inches in plane 7—7, which is approximately 20 percent greater than the standard cylinder wall thickness. In a preferred embodiment, thickness t6 should be approximately 30 to 40 percent less than thickness t5 (FIG. 6), and approximately 15 to 25 percent greater than the standard cylinder bore thickness depicted in FIG. 8. The cylinder wall portion depicted in FIG. 7 is designed using a best-fit circle of r=1.430 inches from a centerline coincident with longitudinal axis 40.

Figure 8:
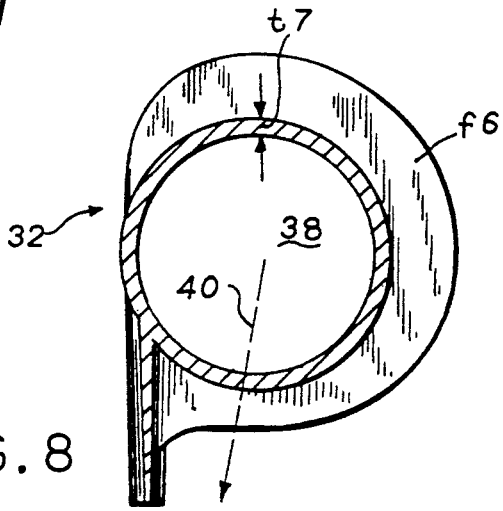
FIG. 8 is a top cross sectional view of the horizontal shaft engine housing, taken along plane 8—8 of FIG. 3.

The remaining cylinder wall portion, between fins f6 and f9, has a standard cylinder bore wall thickness. FIG. 8 is a top view of this cylinder wall section, taken along plane 8—8 of FIG. 3. In FIG. 8, cylinder 32 has a uniform wall thickness t7 equal to about 0.125 inches in plane 8—8. Thickness t7 is preferably about 10 to 20 percent less than thickness t6 (FIG. 7). The cylinder wall portion depicted in FIG. 8 is manufactured using a best-fit circle having a radius of r=1.406 inches from axis 40.

From the above description of the cylinder, it can be seen that the uppermost cylinder wall portion between fins f1 and f3 preferably has a varying wall thickness in a plane normal to axis 40, with reinforcement material placed in two opposed sections to minimize distortion from head bolt torquing. The overall wall thickness of this cylinder wall portion is also increased to accommodate thermal bore distortion. The wall thickness of this section between fins f1 and f3 is greatest because more heat is generated and more loading applied to the material in this portion of the cylinder than in other portions. This cylinder wall portion has a length of about 0.75 to 1 inches in a direction parallel to longitudinal axis 40. The cylinder wall thickness along a plane coplanar with axis 40 is substantially uniform.

The next cylinder wall portion, between fins f3 and f4, has a constant wall thickness in a plane normal to axis 40, yet this constant wall thickness is still greater than the standard bore thickness but less than the wall thickness in the uppermost cylinder wall portion. This cylinder wall portion between fins f3 and f4 is still subjected to a significant amount of heat from the combustion chamber and load from the piston.

The next cylinder wall portion, between fins f4 and f5 has a constant wall thickness in a plane normal to axis 40 which is greater than the standard bore wall thickness but less than the bore wall thickness in the cylinder wall portion between fins f3 and f4. Less reinforcing material is required in the section between fins f4 and f5 because this section is further removed from the combustion chamber and from the piston load.

The cylinder wall portion between fins f6 and f9 is so far removed from the combustion chamber that a standard cylinder wall thickness may be used.

By decreasing the cylinder wall thickness as the distance from the combustion chamber increases, and by only selectively reinforcing the cylinder wall in the uppermost portion where the reinforcement is needed, cylinder bore distortion is minimized without the use of an excessive amount of material. Thus, the cost of manufacturing an engine housing according to the present invention is significantly less than if the cylinder wall thickness was increased along the entire circumference of the cylinder bore and along the entire length of the cylinder.

It has been found that the minimizing of cylinder bore distortion according to the present invention has reduced exhaust emissions of carbon monoxide (CO) and the total of the hydrocarbons (HC) and nitrous oxides ($NO_x$) emissions by about thirty percent. The present invention thus results in a major reduction in exhaust emissions while using the minimum amount of extra material.

Another feature of the present invention is the use of substantially circular and concentric fins f1 through f9 to provide a more even heat dissipation from the cylinder and a more symmetrical structure to the cylinder. The symmetrical, concentric nature of the fins is apparent from FIGS. 3 through 8. As best shown in FIG. 3, all of the fins are of substantially the same size to further equalize the heat dissipation in all directions.

Ideally, the fins would be entirely concentric and symmetrical. This is not completely achievable, however, in the engine depicted in FIG. 3 due to the locations of intake valve guide 34 and exhaust valve guide 36. Thus, the fins must be tapered in those areas near the intake and exhaust ports. See FIGS. 6 through 8. Nevertheless, the fins are still substantially concentric and symmetrical, resulting in improved heat dissipation when compared to the asymmetrical, nonconcentric fins of typical prior art engine housings.

As shown in FIGS. 6 through 8 and 13 through 15, the fins are radiused or rounded near the places where they end instead of abruptly ending as in the prior art (FIG. 2*a*) to provide more even cooling and to minimize bore distortion. For example, fin f4 in FIG. 6 gradually ends in rounded sections 33 and 35. Fin f5 (FIG. 7) has similar rounded sections 37 and 39 (FIG. 7). The other fins have corresponding geometries.

In the present invention, for a 3.5 horsepower 9.02 cubic inch engine, fins f1 through f3 have a radius of 2.094 inches from longitudinal axis 40. Fins f4 through f9 have essentially the same shape to each other, which will be described in connection with FIG. 6.

In FIG. 6, fin f4 should be designed such that the section of the fin on both sides of bolt boss b1 and up to the middle of bolt bosses b1 and b2 is made using a best-fit circle of about r=1.25 inches. The section of the fin between the middle of bolt bosses b1 and b2, and between bolt boss b3 should be designed using a best-fit circle of about r=2.094 inches. The section of fin f4 between bolt bosses b3 and b4 should be designed using an offset, best-fit circle of r=1.812 inches to achieve an effectively decreasing radius. The section of the fin between bolt boss b4 and bolt boss b5 should be designed using a best-fit circle of r=1.812 inches from longitudinal axis 40. The last section of fin f5 around bolt boss b5 should be designed using a best-fit circle of r=1.5 inches from longitudinal axis 40, but is terminated so that a tool may be fit between valve guides 34 and 36 and the cylinder bore wall.

The present invention may also be incorporated into vertical shaft engines, with minor modifications. In a vertical shaft engine, an intake tube must be placed close to the bore wall since the intake port is on the top of the engine housing and not on the side of the housing as in the horizontal shaft engine. Referring to FIG. 9, the intake tube (not shown) is placed near section 32*a* of the bore wall, thereby requiring that fins f3', f4', and f5' be partially eliminated to prevent interference with the intake tube. To compensate for the resultant loss of heat dissipation capacity, the cylinder wall above fin f3' contains additional reinforcing material when compared to cylinder wall thicknesses t1 and t3 (FIGS. 4 and 5) of the horizontal shaft engine.

Figure 11:
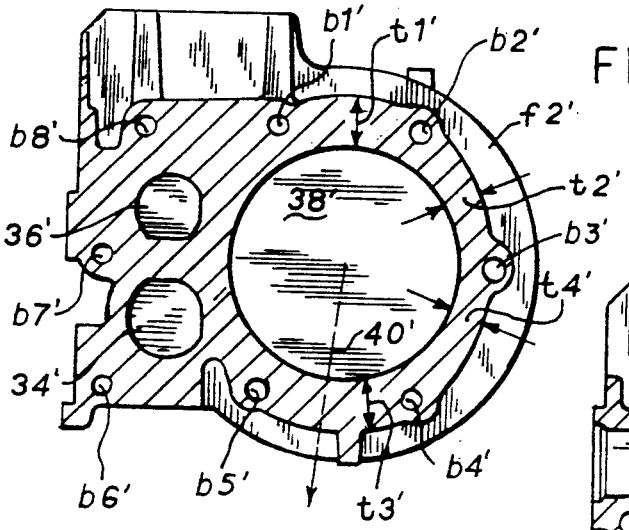
FIG. 11 is a top cross sectional view of the vertical shaft engine housing, taken along plane 11—11 of FIG. 9.

FIG. 10 is a top view of the vertical shaft engine of FIG. 9, with the cylinder head having been removed. FIG. 10 is top cross sectional view of engine housing 30' of FIG. 9, taken along plane 11—11. Referring to FIGS. 10 and 11, thickness t1' is approximately 0.500 inches, which is about the same as the corresponding thickness t1 in FIGS. 4 and 5. Similarly, thickness t3' of FIGS. 10 and 11 is approximately 0.562 inches and 10 to 15 percent greater than thickness t3 of FIGS. 4 and 5. Thicknesses t2' and t4' in FIGS. 10 and 11 are approximately the same as their counterparts, thicknesses t2 and t4 respectively, in FIGS. 4 and 5.

The section of cylinder 32' above fin f3 and between bosses b1' and b2' is designed using a best-fit circle of r=1.780 inches. The section of cylinder 32' between bolt bosses b4' and b5' is designed using a best-fit circle of radius r=1.800 inches. Both of these circles are of greater radius than their corresponding circles in the horizontal shaft engine.

As in the horizontal shaft engine discussed above, the overall wall thickness of cylinder 32' between fins f1' and f3' is greater to accommodate the bolt bosses and to prevent cylinder bore distortion during the torquing of the cylinder head bolts.

Figure 12:
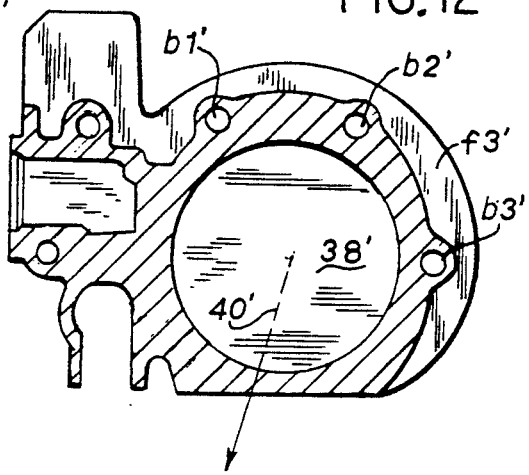
FIG. 12 is a top cross sectional view of the vertical shaft engine housing, taken along plane 12—12 of FIG. 9.

FIG. 12 is a cross sectional top view of the vertical shaft engine, taken along plane 12—12 of FIG. 9. As shown in FIG. 12, the bore wall has been truncated in that section below bosses b4' and b5' (FIG. 11) to allow the intake tube to pass close to the bore wall. Fin f3' has also been truncated for the same reason.

Figure 13:
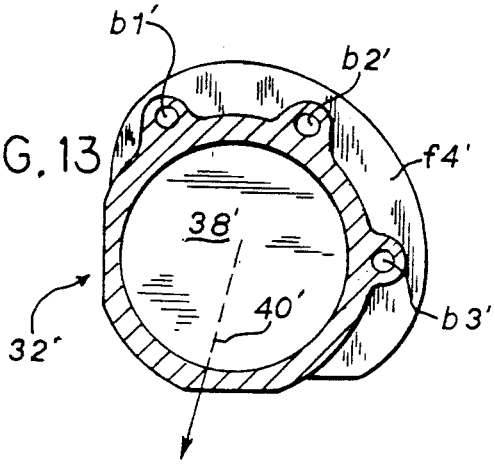
FIG. 13 is a top cross sectional view of the vertical shaft engine housing, taken along plane 13—13 of FIG. 9.

FIG. 13 is a cross sectional top view of the cylinder, taken along plane 13—13 of FIG. 9. As shown in FIG. 13, the cylinder wall has been truncated in the sections opposite bosses b1' through b3' to accommodate both the intake tube as well as the intake and exhaust valve guides 34' and 36' respectively (FIG. 11). Fin f4' has also been correspondingly truncated for the same reason.

Figure 14:
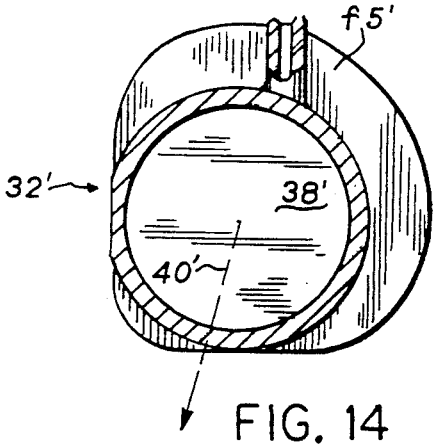
FIG. 14 is a top cross sectional view of the vertical shaft engine housing, taken along plane 14—14 of FIG. 9.

FIG. 14 is a top cross sectional view of the vertical shaft engine housing, taken along plane 14—14 of FIG. 9. As shown in FIG. 14, cylinder 32' has its wall truncated to accommodate the intake and exhaust valve guides. Fin f5' is also truncated to avoid interference with the intake tube and with the intake and exhaust valve guides.

Figure 15:
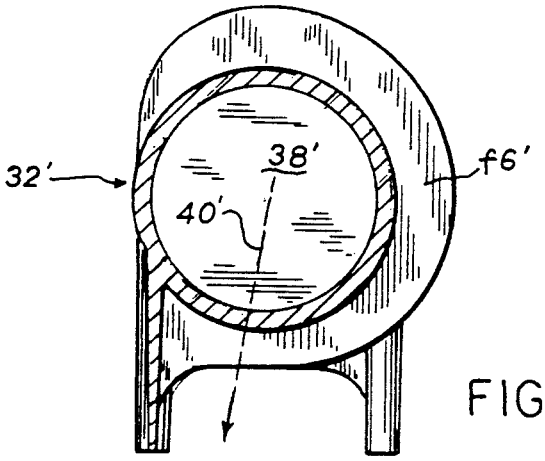
FIG. 15 is a top cross sectional view of the vertical shaft engine housing, taken along plane 15—15 of FIG. 9.

Lastly, FIG. 15 is a top cross sectional view taken along plane 15—15 of FIG. 9. FIG. 15 depicts the cylinder wall portion having a substantially constant thickness, which is substantially the same as the standard cylinder wall thickness. Fin f6' has been partially truncated to allow for some space between the valve guides and the fin so that a tool maybe inserted between them.

Except for the differences discussed above, cylinder 32' is reinforced in substantially the same places and in substantially the same amounts as cylinder 32 of FIGS. 3 through 8. Likewise, fins f1' through f9' has substantially the same configuration as fins f1 through f9 respectively except as otherwise described above.

Although several preferred embodiments of the present invention have been shown and described, alternate embodiments will be apparent to those skilled in the art and are within the intended scope of the present invention. Therefore, the invention is to be limited only by the following claims.

I claim:

1. A housing for an internal combustion engine, comprising:

a crankshaft axis about which a crankshaft rotates;

a cylinder having a cylinder length, including:

a cylinder bore having a longitudinal axis along which a piston reciprocates;

a first cylinder wall portion having a length that is substantially less than said cylinder length, said first cylinder wall portion also having:

a wall thickness in a plane substantially normal to said longitudinal axis that decreases from a first thickness at a first section to a second thickness at a second section displaced from said first section; and a third section in said plane opposite to said first section and displaced from said second section, said third section having a third thickness that is greater than said second thickness.

2. The housing of claim 1, wherein said third thickness is between 100 to 200 percent greater than said second thickness.

3. The housing of claim 1, wherein said cylinder further comprises:

a second cylinder wall portion disposed between said first cylinder wall portion and said crankshaft axis and having a third wall thickness in a second plane substantially normal to said longitudinal axis, said third thickness being less than said first thickness; and a third cylinder wall portion disposed between said second cylinder wall portion and said crankshaft axis and having a fourth wall thickness in a third plane substantially normal to said longitudinal axis, said fourth thickness being less than said third thickness.

4. The housing of claim 3, wherein said fourth thickness is between 30 to 40 percent less than said third thickness.

5. The housing of claim 3, wherein said cylinder further comprises:

a fourth cylinder wall portion disposed between said third cylinder wall portion and said crankshaft axis and having a fifth wall thickness in a plane substantially normal to said longitudinal axis, said fifth thickness being less than said fourth thickness.

6. The housing of claim 5, wherein said fifth thickness is between 10 to 20 percent less than said fourth thickness.

7. A housing for an internal combustion engine, comprising:

a crankshaft axis about which a crankshaft rotates;

a cylinder including:

a cylinder bore having a longitudinal axis along which a piston reciprocates;

a first cylinder wall portion, having:

a first wall thickness of a first section in a first plane substantially normal to said longitudinal axis that decreases to a second thickness at a second section displaced from said first section;

a third thickness in said first plane opposite to said first section and displaced from said second section, said third thickness being greater than said second thickness; and a second cylinder wall portion, disposed between said first cylinder wall portion and said crankshaft axis, having a fourth wall thickness in a second plane substantially normal to said longitudinal axis, said fourth thickness being less than said first thickness.

8. The housing of claim 7, wherein said third thickness is between 50 to 200 percent greater than said second thickness.

9. A housing for an internal combustion engine, comprising:

a crankshaft axis about which a crankshaft rotates;

a cylinder, including:

a cylinder bore having a longitudinal axis along which a piston reciprocates;

a first cylinder wall portion having a first wall thickness of a first section in a first plane substantially normal to said longitudinal axis that decreases to a second thickness at a second section displaced from said first section;

a second cylinder wall portion, disposed between said first cylinder wall portion and said crankshaft axis, having a third wall thickness in a second plane substantially normal to said longitudinal axis, said third thickness being less than said first thickness; and a third cylinder wall portion, disposed between said second cylinder wall portion and said crankshaft axis, having a fourth wall thickness in a third plane substantially normal to said longitudinal axis, said fourth thickness being less than said third thickness.

10. The housing of claim 9, wherein said fourth thickness is between 30 to 40 percent less than said third thickness.

11. The housing of claim 9, wherein said cylinder further comprises:

a fourth cylinder wall portion, disposed between said third cylinder wall portion and said crankshaft axis, having a fifth wall thickness in a fourth plane substantially normal to said longitudinal axis, said fifth thickness being less than said fourth thickness.

12. The housing of claim 11, wherein said fifth thickness is between 10 to 20 percent less than said fourth thickness.

* * * * *